US005480037A

United States Patent [19]

Pope

[11] Patent Number: 5,480,037

[45] Date of Patent: Jan. 2, 1996

[54] NOTE PAPER HOLDER AND METHOD

[76] Inventor: Kip R. Pope, 1804 Bridgestone Dr., Champaign, Ill. 61821

[21] Appl. No.: 218,272

[22] Filed: Mar. 25, 1994

Related U.S. Application Data

[63] Continuation-in-part of Ser. No. 897,777, Jun. 12, 1992, abandoned.

[51] Int. Cl.[6] ..... B42F 17/08

[52] U.S. Cl. ..... 211/50; 206/215; 206/371

[58] Field of Search ..... 211/50, 69.1, 69.8; 248/205.3; 206/215, 371, 214, 449; 40/358

[56] References Cited

U.S. PATENT DOCUMENTS

| | | | |
|---|---|---|---|
| 1,623,604 | 4/1927 | Suvan | 211/50 |
| 1,848,694 | 3/1932 | Bucklin | 211/50 |
| 1,883,647 | 10/1932 | Ellison | 211/50 |
| 2,520,367 | 8/1950 | Lafforthun | 211/50 |
| 2,907,584 | 10/1959 | Neilsen | 40/358 |
| 3,106,920 | 10/1963 | Scholfield et al. | 211/50 |
| 3,817,393 | 6/1974 | Neilsen | 211/50 |
| 4,192,425 | 3/1980 | Landau et al. | 211/50 |
| 4,696,399 | 9/1987 | Windorski | 211/50 |
| 4,844,264 | 7/1989 | Deskiewicz, Jr. | 211/50 |
| 5,083,663 | 1/1992 | Conway et al. | 211/50 |

*Primary Examiner*—P. Austin Bradley

*Assistant Examiner*—Chuck Y. Mah

*Attorney, Agent, or Firm*—Jack E. Dominik

[57] ABSTRACT

A note paper pad holder and method, the tablet-like note paper pad of which is a plurality of usually rectangular stacked sheets secured to each other at one end is disclosed. The holder portion has a receiver or magazine section, and a mount. The receiver or magazine section has lateral sides, a head, and an open foot portion. The open foot portion, however, is optionally interrupted at a mid-portion with a centering stop which extends upwardly from the base portion of the receiver to which the pad is secured. A pair of yieldable side grips are provided at the forward portion of the sides terminating adjacent the head to yieldably secure the forward secured portion of the pad. The head of the pad abuts the head of the receiver and is secured in that relationship by a combination of the yieldable grips and the front centering stop. A writing instrument groove is optionally provided within the head and has a groove for receiving the instrument, the groove being interrupted in a mid-portion by a yieldable or spring like member to hold the writing instrument in place against gravitation or bumping removal. The base mount has a pair of laterally extending trunions and is removably secured to a host supports such as a bean bag, stand with weighted base, yoke support with mating release tapes, wall bracket, and the like. The method of the invention contemplates the removable encapsulation of a pad of paper in such a fashion as to define a pair of quadrants adjacent the unsecured lower corners of the pad whereby the pad can be riffled by the user and the top paper removed.

5 Claims, 9 Drawing Sheets

NOTE PAPER HOLDER AND METHOD

CROSS-REFERENCE TO RELATED APPLICATION

The present application is a continuation-in-part of application Ser. No. 897,777, filed Jun. 12, 1992 by the same inventor herein entitled "Note Paper Holder and Method" now abandoned.

FIELD OF THE INVENTION

The present invention relates to a holder for note paper and a method for dispensing the note paper. While the preferred embodiment contemplates note pads known as "Post-It" note pads, a trademark of Minnesota Mining and Manufacturing Company, it can also be used with other pads of pressure sensitive papers secured to each other, or conventional note pads bound at the front end portion for tearing individual or multiple pieces from the same.

SUMMARY OF THE PRIOR ART

The prior art is exemplified by U.S. Pat. Nos. 2,100,720; 4,667,828; and 4,696,399. The subject matter appears in Patent Office Class 206, subclass 555 and elsewhere. Primarily the dispensers are rectangular, and secure the pads in an intermediate portion of the dispenser. The bulk of the dispensers have a front wall, rear wall and sidewalls defining a recess in which the pad is positioned. While this does position the pad, it makes it difficult to remove the individual pieces of paper by fanning or riffling the corner portions to release the top paper from the balance of the pad. In addition, the prior art does not necessarily show holders which permit the pad to be positioned in a plane other than horizontal such as mounted on a wall, front of a desk, file drawer, kitchen cabinet and the like. Nor is provision made in the prior art for a pencil, pen, or writing instrument to be readily carried for use with the pad. Additionally, the prior art fails to show positive gripping action in the pad to prevent dislodgment by jostling or vertical mounting.

SUMMARY OF THE INVENTION

The present invention contemplates a note paper pad holder and method, the tablet-like note paper pad of which is a plurality of usually rectangular stacked sheets secured to each other at one end. The holder portion has a receiver or magazine section, and a mount. The receiver or magazine section has lateral sides, a head, and an open foot portion. The open foot portion, however, is optionally interrupted at a mid-portion with a centering stop which extends upwardly from the base portion of the receiver to which the pad is secured. A pair of yieldable side grips are provided at the forward portion of the sides terminating adjacent the head to yieldably secure the forward secured portion of the pad. The head of the pad abuts the head of the receiver and is secured in that relationship by a combination of the yieldable grips and the front centering stop. In a non-vibratory horizontal mode the yieldable grips secure the pad to the extent that the centering stop may be lowered or eliminated. A writing instrument groove is optionally provided within the head and has a groove for receiving the instrument, the groove being interrupted in a mid-portion by a yieldable or spring like member to hold the writing instrument in place against gravitation or bumping removal. The lower portion of the receiver close to the foot has two open access quadrants the forward portions of which are defined by the lateral sides, and the medial portion of which is defined by the optional centering stop. This permits the user to fan or riffle the corners of the pad through either of the open access quadrants. This insures ambidextrous usage of the note paper holder. The base mount has a pair of laterally extending trunions and is removably secured to a host support such as a base with self-adhesive foam tape to be mounted on a surface, a bean bag, stand with weighted base, yoke support with mating clamps, wall bracket, and the like. The method of the invention contemplates the removable encapsulation of a pad of paper in such a fashion as to define a pair of quadrants adjacent the unsecured lower corners of the pad whereby the pad can be riffled by the user and the top paper removed. The pad is yieldably secured at its head portion from the lateral sides thereof, and is desirably secured to its host member by means of a pressure sensitive lower head portion of the pad where such is provided. Otherwise the yieldable means for securing the same in combination with engaging the same at the foot of the pad. Dispensing the paper is done by the operator by riffling the corners and then removing the upper paper.

In view of the foregoing, it is a principal object of the present invention to provide a holder for a pad of notebook-like material which removably secures the same in a shock resistant environment to hold the pad at various angles thereby permitting the user to locate his pad in virtually any orientation in a vehicle, kitchen environment, desk application, whether on top, on the front of a drawer, a file, or a wall.

Yet another object of the present invention looks to a method for dispensing paper sheets whereby either a left-handed or right-handed person can readily engage the same, cause the upper sheet to separate from the balance of the sheets without dislodging the pad from the holder, and thereafter remove the upper sheet.

Yet another advantage of the method is the provision for a coordinated method of dispensing paper by paper from the pad so that each sheet is separated from the next, and the tendencies of such pads to release two or three sheets at the same time is minimized if not eliminated.

In addition, the invention contemplates in at least one embodiment angular adjustment of the pad. In another embodiment, a writing instrument mount is a part of the dispenser.

BRIEF DESCRIPTION OF THE DRAWINGS

The present invention will become apparent as the following description of an illustrative embodiment takes place, accompanied by the illustrative drawings, in which.

DESCRIPTION OF A PREFERRED EMBODIMENT

Figure 1:
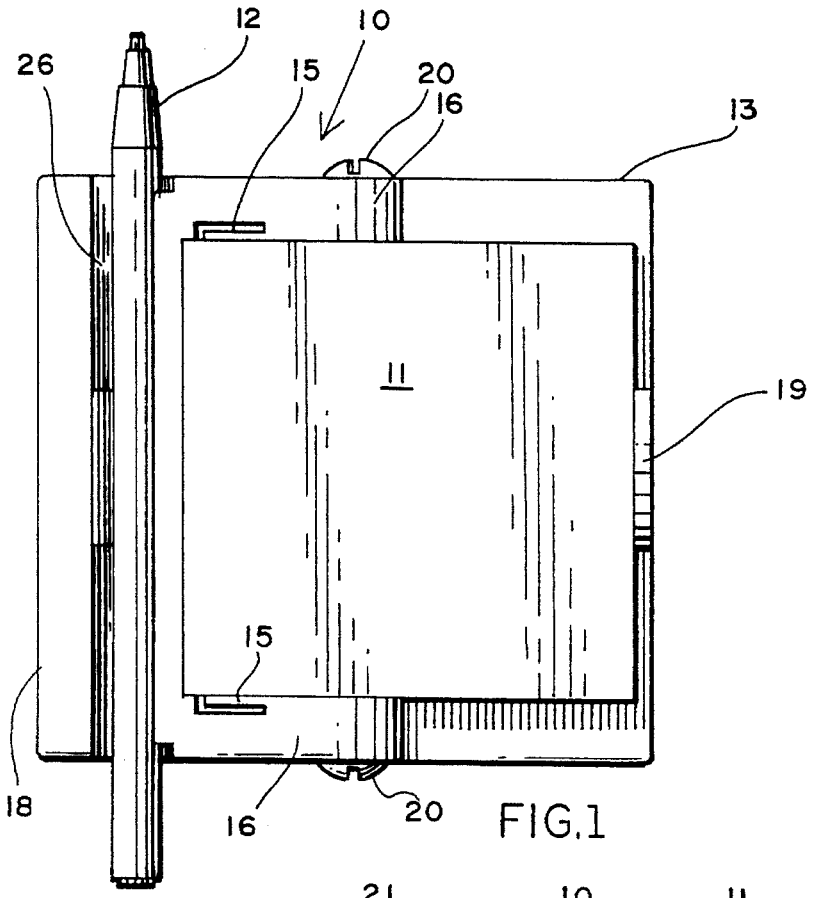
FIG. 1 is a plan view of a typical holder and pad showing a writing pen in place.
Figure 2:
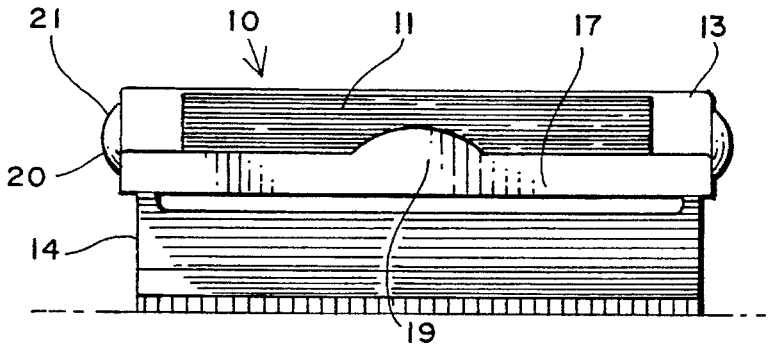
FIG. 2 is a front view of the pad showing its lower portion as it fits within the holder assembly and more particularly the magazine portion of the holder assembly.

The holder assembly 10 is shown in plan view in FIG. 1 where it will be seen that a pad of individual sheets 11 and a pen 12 are mounted in the magazine portion 13 of the holder assembly 10. Turning briefly to FIG. 2, it will be seen that the magazine 13 of the holder assembly 10 is secured on top of a mounting base 14. Turning back now to FIG. 1, it will be further seen that a pair of leaf-like grips 15 secure the head portion of the pad 11 between the sides 16 of the magazine 13. The pad 11 fits on top of the magazine bottom 17 (shown in FIG. 2). The pad 11 rides forward between the side 16 and on top of the bottom 17 to abuttingly engage the head 18 of the magazine 13. At its opposite end, the pad 11 abuts the optional foot stop 19 which is at the foot or base of the pad 11. This relationship between the pad 11 and the foot stop 19 is also shown in FIG. 2.

Figure 3:
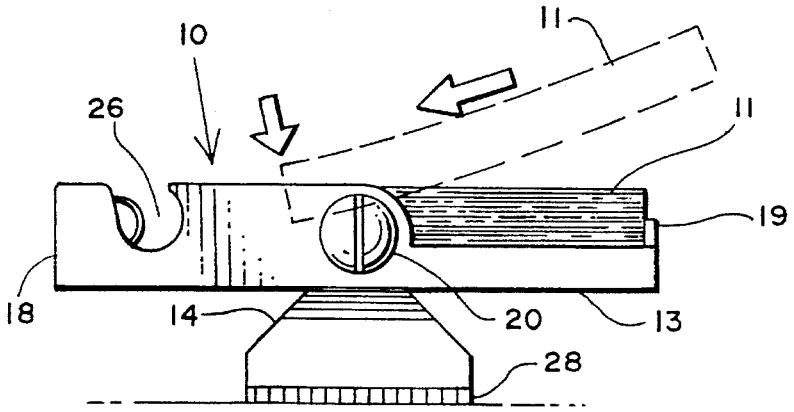
FIG. 3 is a partially diagrammatic side view showing how the pad is inserted into the magazine portion of the holder assembly where the same is secured to a flat surface.
Figure 4:
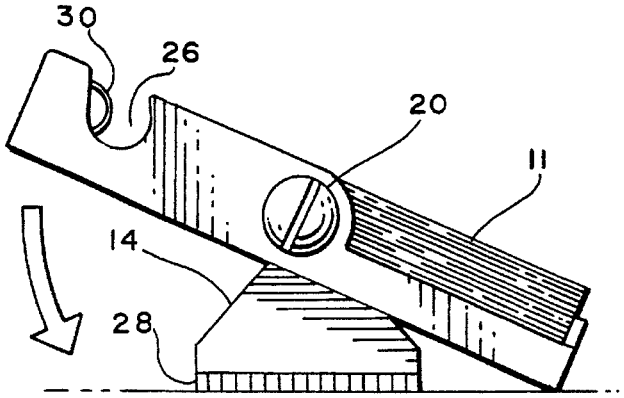
FIG. 4 is a sequential view of the holder as shown in FIG. 3 demonstrating how the magazine portion can be tilted approximately 25° forward or backward.
Figure 5:
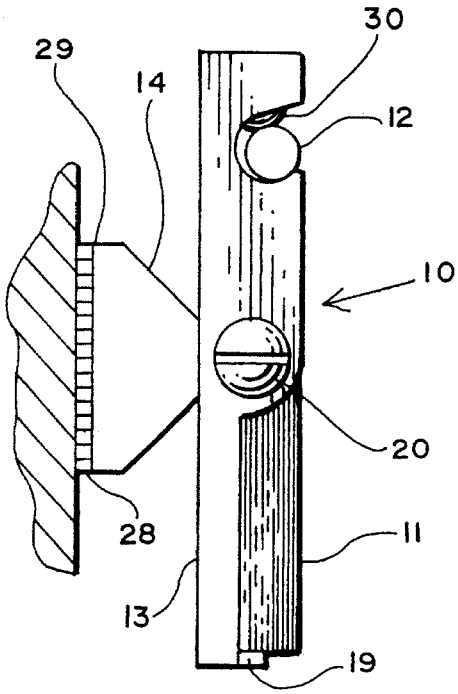
FIG. 5 is but another illustrative view taken from the same vantage point as FIGS. 3 and 4 but illustrating the holder and its magazine and base as secured to a vertical wall such as in a kitchen, the end of a desk drawer, adjacent a secretarial desk, or even on the front face of a file drawer.

FIGS. 3, 4 and 5 illustrate sequentially and partially diagrammatically the applications of the invention. As illustrated in FIG. 3, the pad 11 is inserted into the magazine 13 at an angle forwardly and downwardly until the head of the pad 11 abuts the head 18 of the magazine 13. It is then depressed gently, and the lower end portion of the pad 11 then is secured flat against the bottom 17. Also the pad is optionally engaged by the foot stop 19 where one is used.

FIG. 4 illustrates how the magazine 17 can be rotated around the trunion assembly 20 to tilt approximately 25° in one direction or the other while the mounting base 14 is secured by means of a velcro releasable assembly or self-adhesive tape to a base.

FIG. 5 illustrates another versatile aspect of the preferred embodiment, where the mounting base 14 is secured by means of the Velcro or self-adhesive tape 28 secured to the bottom 29 of the mounting base 14 and mounted to a wall such as a kitchen wall, cabinet wall, or wall in an office or shop. It further illustrates the action of the spring 30 to coact with the pen or writing instrument 12 to secure the same in place. The trunion assembly 20 also permits angling the reservoir 13 from the vertical while the base is mounted in an essentially vertical orientation.

Figure 16:
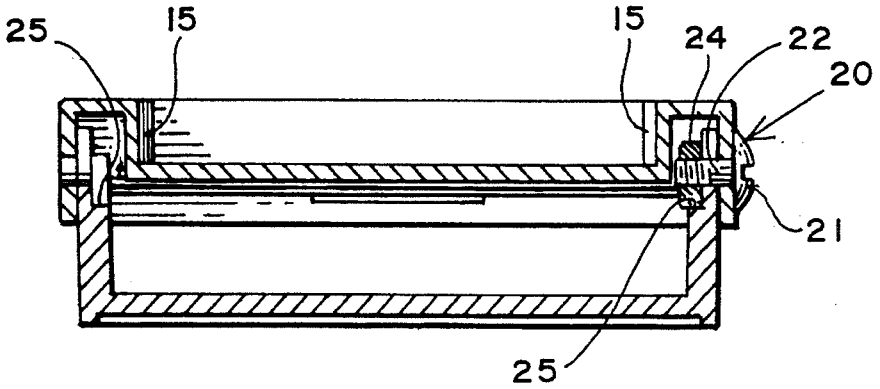
FIG. 16 is a transverse sectional view of the dispenser magazine portion taken along section line 16—16 of FIG. 15.

Before reviewing alternative illustrative embodiments of environment, reference should be made to FIG. 16 where the trunion assembly 20 is shown as including a slotted screw head 21 and threaded shaft 22, which threaded shaft 22 engages, as shown here, a hexagonal nut 24 which, in turn, is secured by means of nut stop 25 which is mounted in the sides 16 and formed therein to engage the nut so that as the slotted screw head is rotated, such as by a penny, dime, or screwdriver the tilting arrangement can be frictionally loosened or tightened. Alternatively, a knob may be substituted for the slotted screw head.

Figure 6:
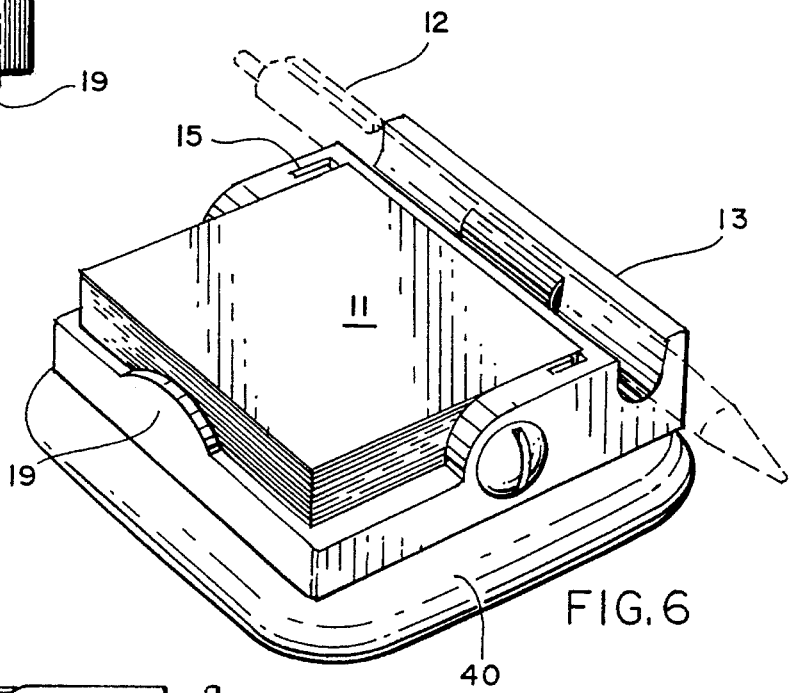
FIG. 6 is a perspective view of an exemplary holder and magazine portion which is secured to a bean bag so that the same can be mounted on irregular surfaces such as the console of an automobile, the knee of a user, the arm of a chair, and other environments.
Figure 7:
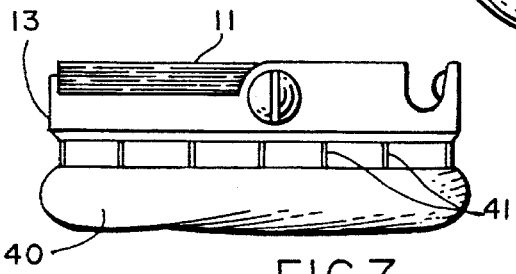
FIG. 7 is a side elevation of the bean bag embodiment shown in FIG. 6 illustrating the friction fins which are used to secure the magazine portion of the holder to the bean bag.

Returning now to FIG. 6, it will be seen that a typical magazine 13 can have a substituted base in the form of a bean bag 40. The bean bag 40, as illustrated in FIG. 7, is secured to the underneath portion of the reservoir 13 by means of plastic collars and friction fins. The bean bag configuration, as set forth above, is ideal for mounting on the console of an automobile between the driver and passenger where from make-to-make and model-to-model the upper configuration of the console varies. Common with most consoles, however, are certain upraised portions to which the bean bag 40 will conform and along with its weight, secure the holder, magazine, and pad for further use.

Figure 8:
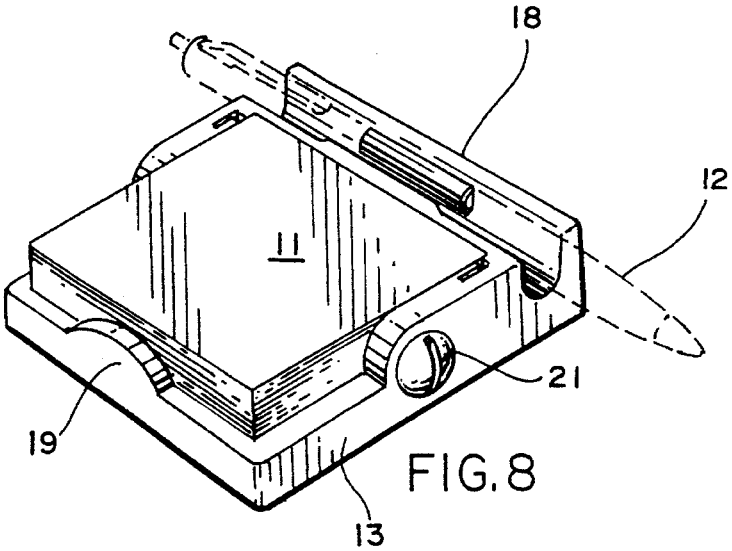
FIG. 8 illustrates another example of an illustrative holder where the magazine can be secured to a wall bracket.
Figure 9:
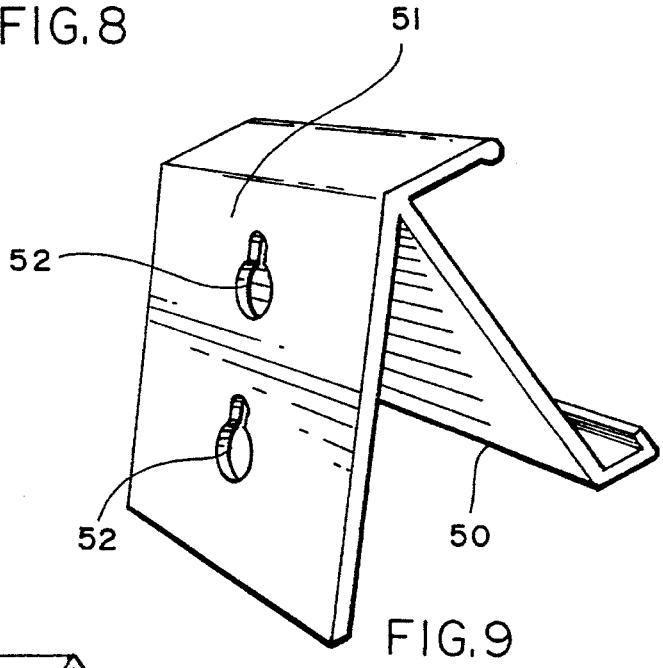
FIG. 9 is a perspective view of a wall bracket for receiving the magazine portion of the holder assembly shown in FIG. 8.
Figure 10:
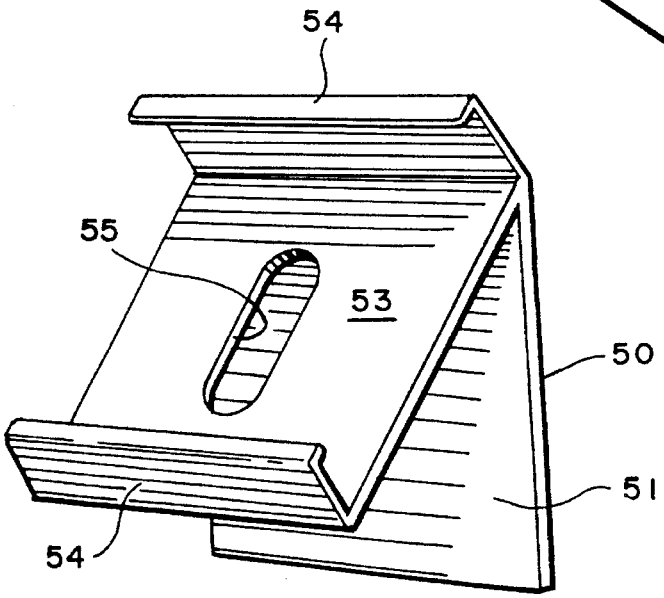
FIG. 10 is a rotated view of the wall bracket shown in FIG. 9 illustrating the end rails and lock slot for the same.

Yet another embodiment of the magazine 13 of the holder assembly 10 is illustrated in FIG. 8, taken along with FIGS. 9 and 10, whereby a wall bracket 50 including a wall face 51, and a keyhole mounting slot pair for engaging screws (not shown) can be removably secured to a vertical wall face. This can be the front of a kitchen cupboard, the end of a kitchen cupboard, and virtually any other location where the wall bracket 50 can be mounted. The magazine 13 can be removably secured therefrom by means of sliding the same into position between the opposed end rails 54 of the wall bracket 50, and thereafter locked in place by means of the lock slot 55 provided in the base 53 of the wall bracket 50.

Figure 11:
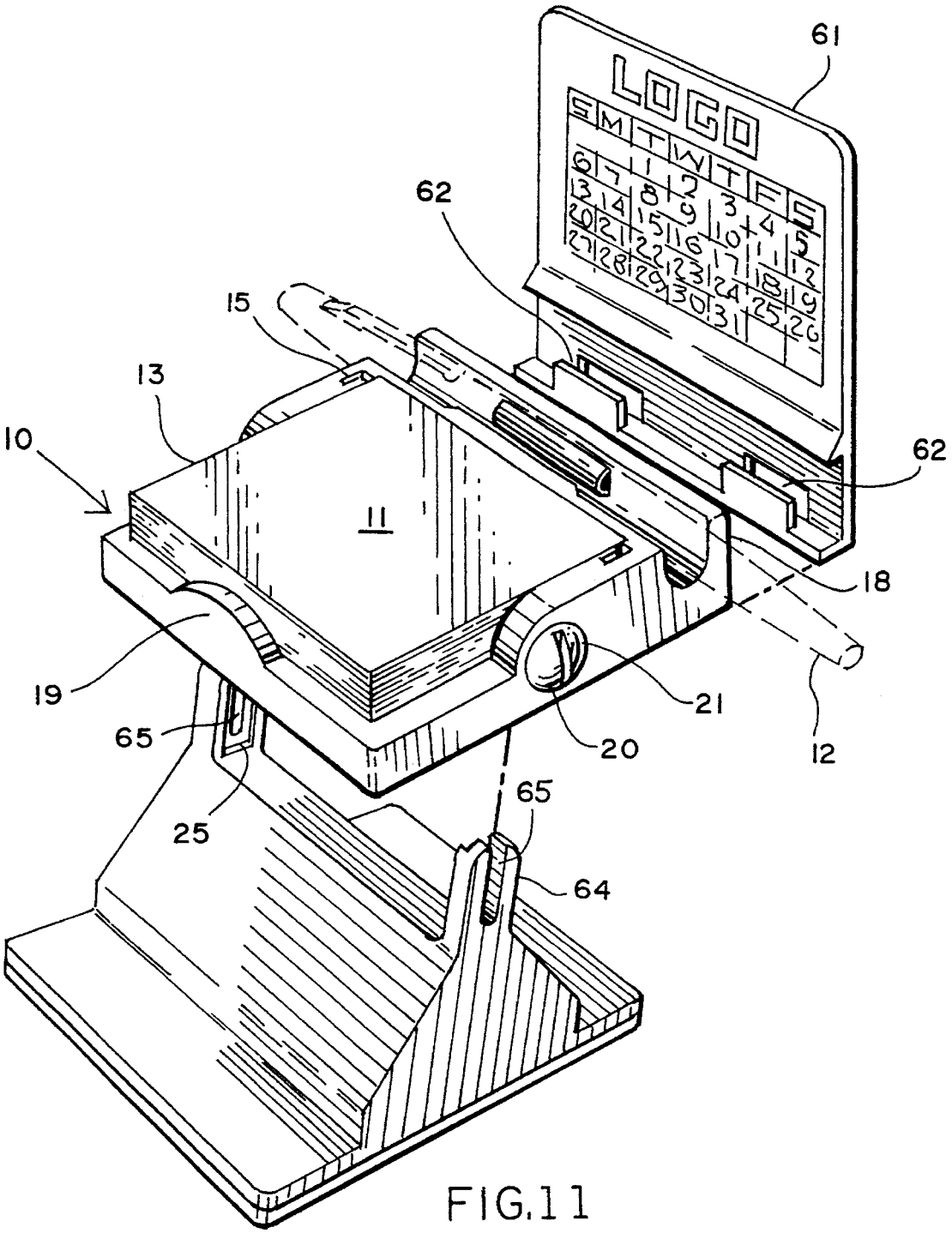
FIG. 11 is but a further embodiment shown in perspective with the magazine of the holder for mounting on a weighted base which can be secured with a non-skid pad or other securing element to a desk top, with the additional feature of a snap-on calendar-like accessory which, in addition to a calendar, can display certain readily required telephone numbers or other information.
Figure 12:
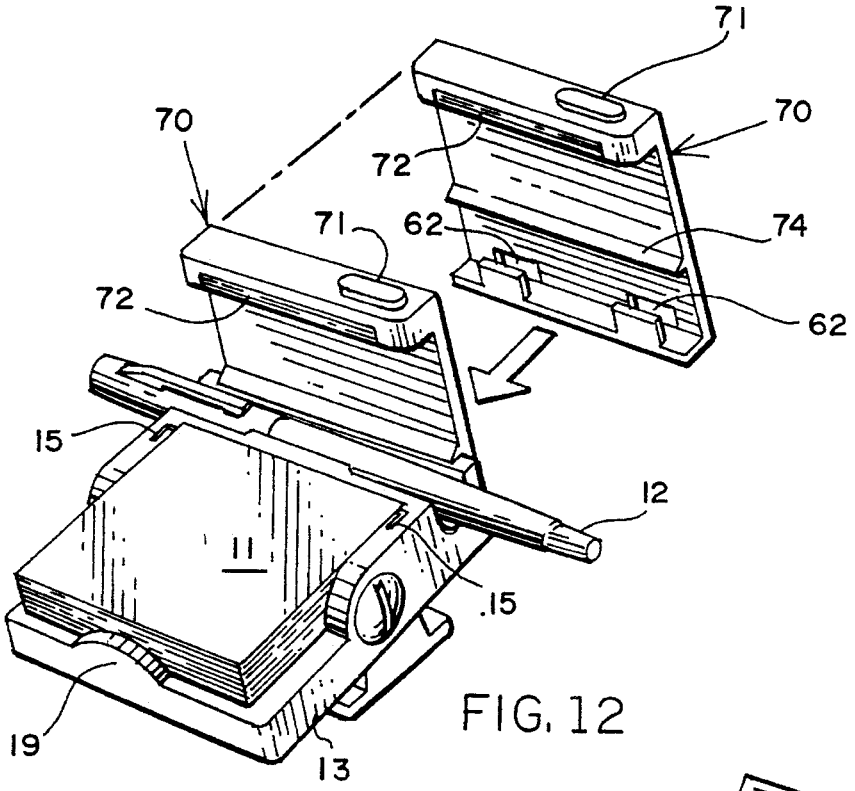
FIG. 12 is but another illustration of an illustrative holder magazine portion with a demountable back light for use primarily in automotive, aircraft, and marine situations where lighting on the pad is not of the intensity desired, or for use on a night stand by a bed for making notes or memos in the dark.
Figure 14:
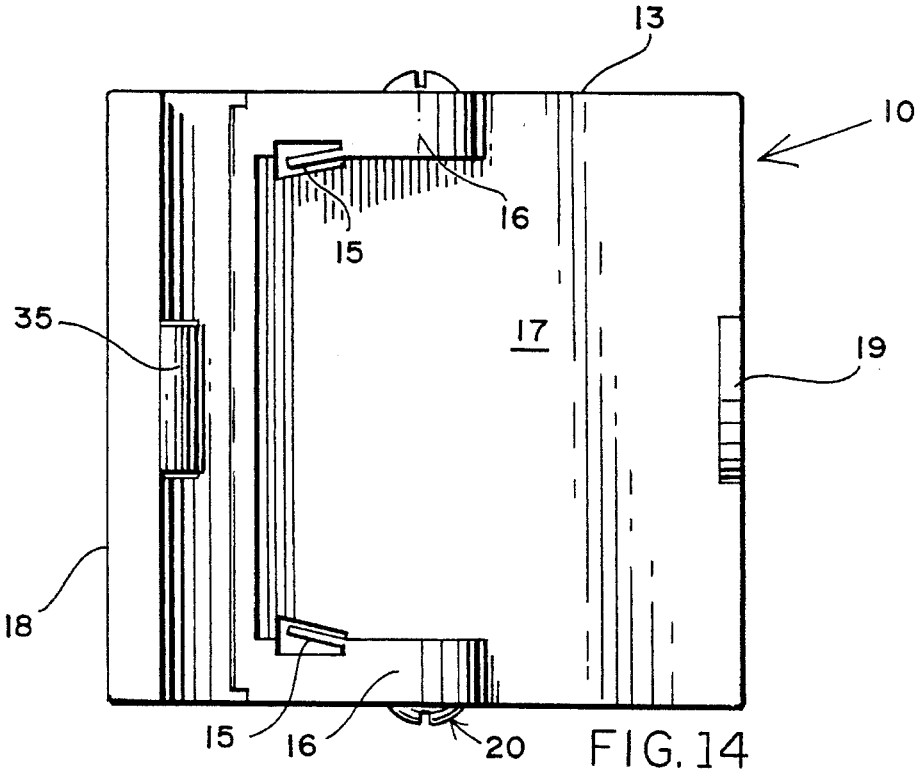
FIG. 14 is a plan top view of the magazine showing it without the pad in place.
Figure 15:
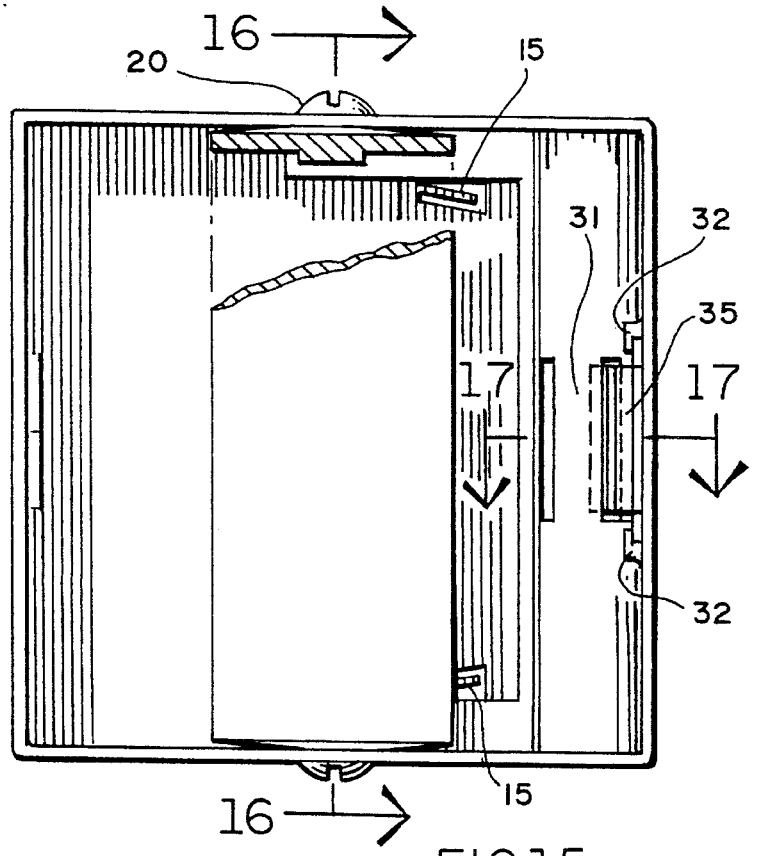
FIG. 15 is an underneath view with a cut away base taken on the same scale as FIG. 14.

Yet another embodiment of the holder assembly 10 is illustrated in FIG. 11 where it will be seen that the novelty relates to a weighted base member 60 along with the provision for a calendar-like face 61 to be secured to the head 18 of the magazine 13. This is accomplished through a calendar clip assembly 62 at the lower portion of the calendar face 61 which secured to the underneath end portion of the head 18 as shown in FIGS. 14 and 15. A modification of the calendar face 61 presentation is shown in FIG. 12 where a back light assembly 70 is provided which, with the calendar clip mounting base 62, can be secured to the head 18 of the receiver 13 in much the same fashion as the calendar face. Provision is made, however, for a light switch 71 at the upper portion of the back light assembly 70 which activates a light through the lens 72 to illuminate the pad 11 in various environments where such additional illumination is needed, particularly as might be involved in a vehicle environment.

Figure 13:
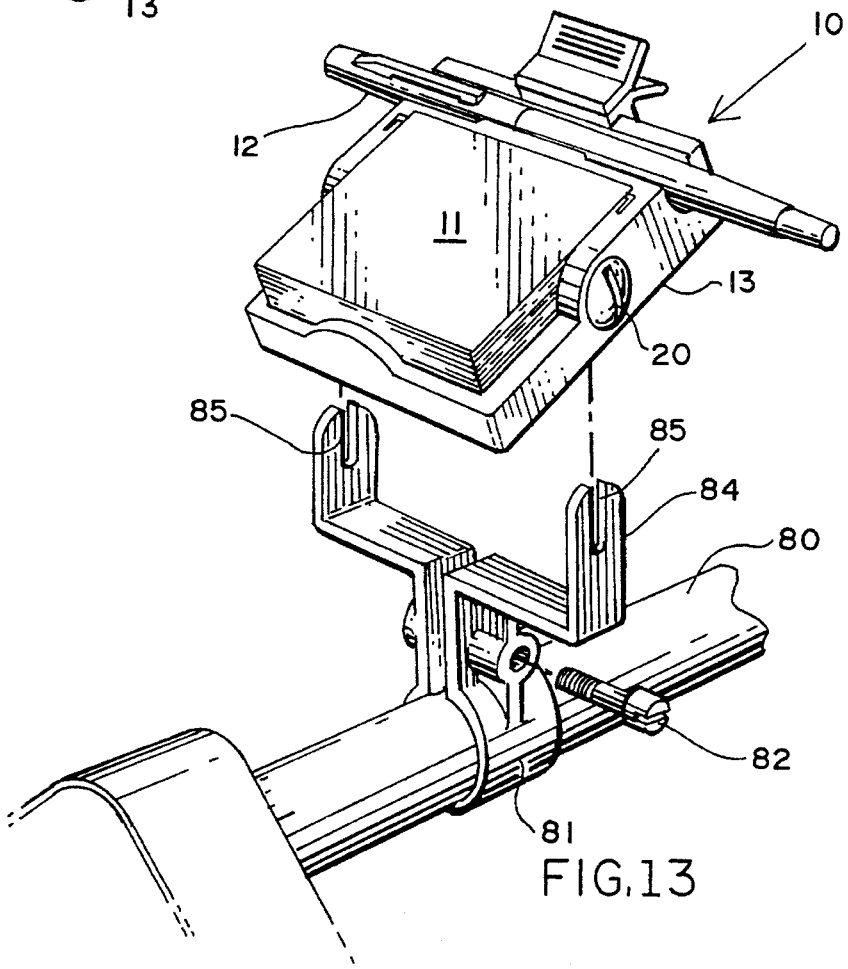
FIG. 13 is an exploded perspective view of yet another holder assembly secured to the yoke of a control column of an airplane by means of a modified mounting base.

Indeed, such a vehicle environment is illustrated in FIG. 13 which is an exploded assembly of the magazine 13 portion of the holder assembly 10 in which the mounting base is in the form of a control yoke mount 80 which is secured to the control column of an aircraft by means of column clamp member 81, secured again by clamping screw 82 to the split base 84. Thereafter, the upper portion of the split base 84, by means of its trunion slots 85, can be secured to the trunion assembly 20 of the magazine 13.

In FIG. 14, the elements will be reviewed as to the magazine 13. The magazine 13 has a bottom 17 which is flanked at its forward portion by the sides 16 and terminating in a C-shaped assembly by means of the head 18. The grips 15 are at the forward portion of the sides 16 and engage the note pad as earlier described. The note pad is then optionally secured at its remote end portion by means of the foot stop 19. To be noted also in FIG. 14 is the pen mounting spring 35 in the pen slot 26. This is but a part of the pen grip assembly 30 which will be described hereinafter. The pen grip assembly 30 includes, as shown in FIG. 15, the spring stop 31 and the spring end stops 32. FIG. 16 has already been described, and its function is primarily to illustrate the trunion assembly 20 with the mounting screw 21.

Figure 17:
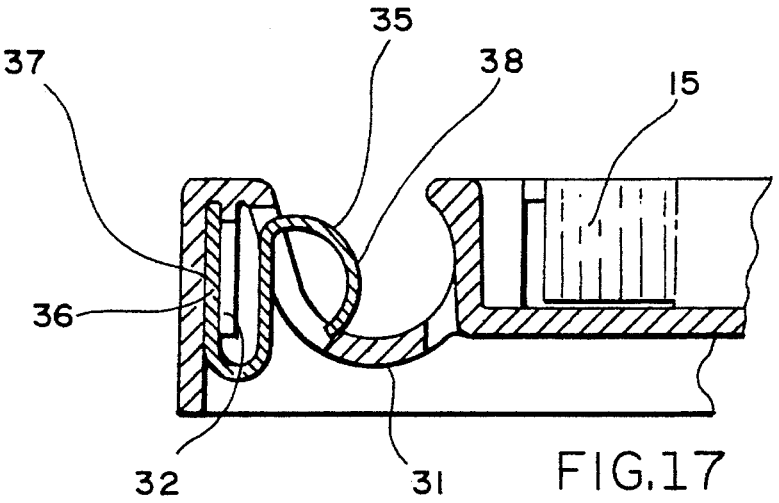
FIG. 17 is an enlarged transverse sectional section of FIG. 15 illustrating the mounting spring as secured.
Figure 18:
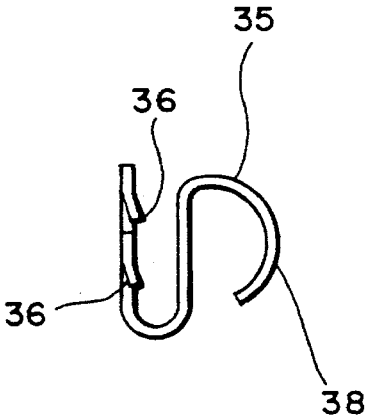
FIG. 18 is an end view of the mounting spring.
Figure 19:
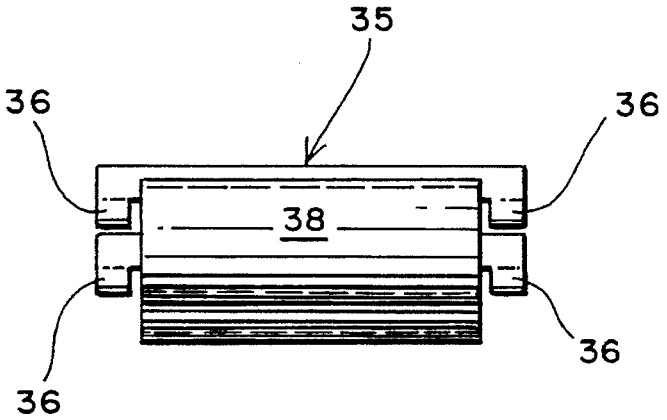
FIG. 19 is a side elevation of the mounting spring.

FIG. 17 shows the spring 35 with its barbed foot 36 engaging the foot mounting slot 37 and the curved finger 38 extending forward to where its end engages the spring stop 31. The spring 35 is further shown in front elevation in FIG. 19.

In review, the basic pad holder assembly 10 finds adaptability of the magazine 13 and a wide variety of mounting bases 14, 29, 40, 50 available which are engaged by means of the trunion assembly 20.

Alternative Embodiment

Figure 20:
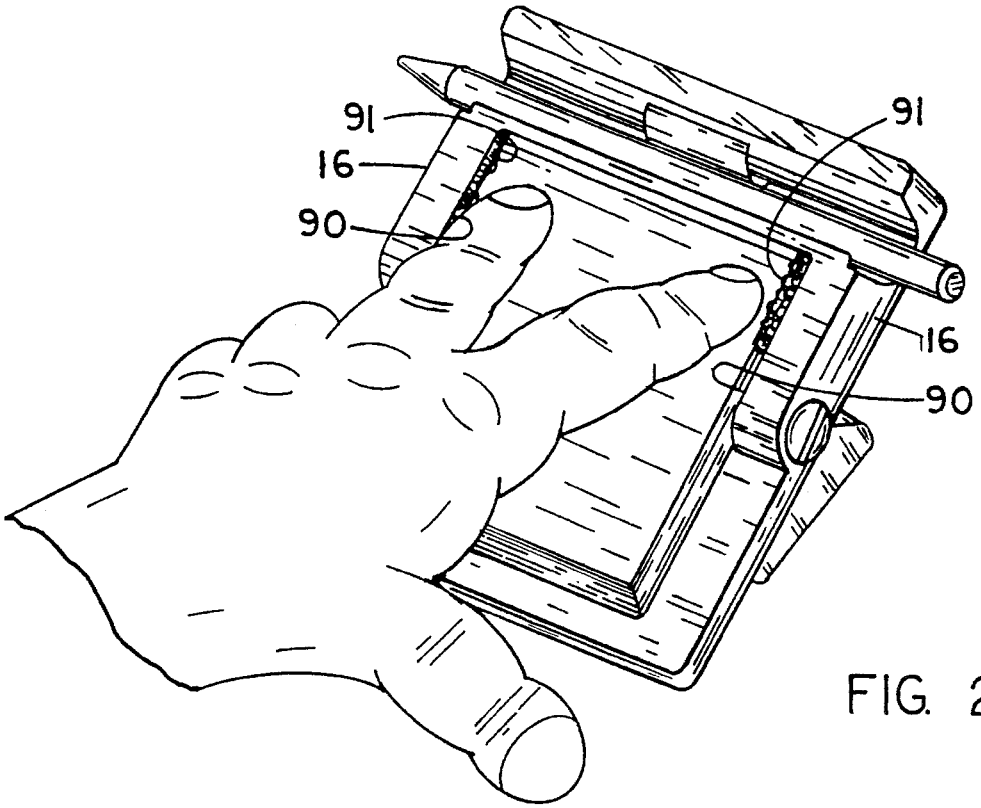
FIG. 20 shows an alternative embodiment of the present invention in perspective.

The alternative embodiment will be best understood by initial reference to FIG. 20 where it will be seen that instead of the grip 15 of the first embodiment, the sidewall of the magazine has a flat forward portion 90. This flat forward portion 90 has secured to it, either by gluing or by a pressure sensitive backing, a typical loop portion of a removably securable material sold by the trademark "Velcro". Velcro has a hook portion and a loop portion. The insert 91 shown here utilizes the loop portion.

As shown in perspective, it will be seen that the removable securable material is located at the forward portion of the sides 16, and with their lower edges immediately adjacent the flat bottom portion 17 of the magazine. The location of the removable securable loop insert 91 so that the last sheet on the bottom of the pad 11 will be engaged between certain of the loops. The balance of the structure remains the same so that the sheets in the pad 11 can be engaged at either of the lower corners, whether left-hand or right-hand.

Figure 21:
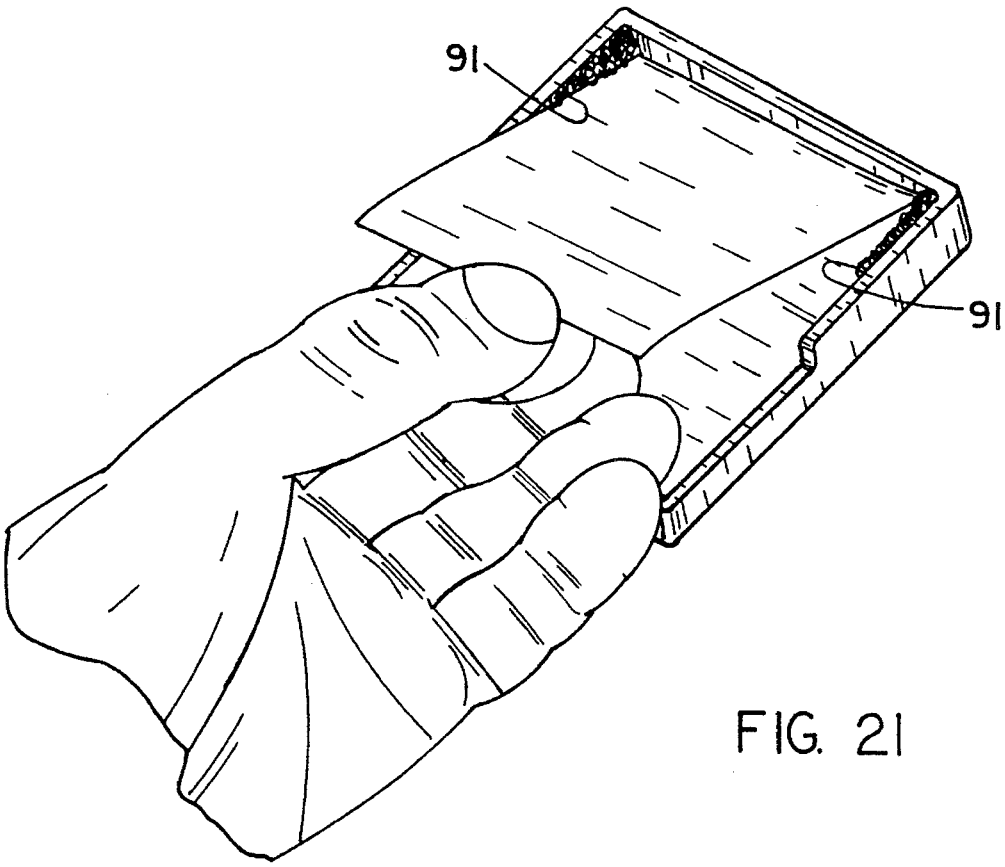
FIG. 21 is a further alternative embodiment of the structure shown in FIG. 20 and in perspective.
Figure 22:
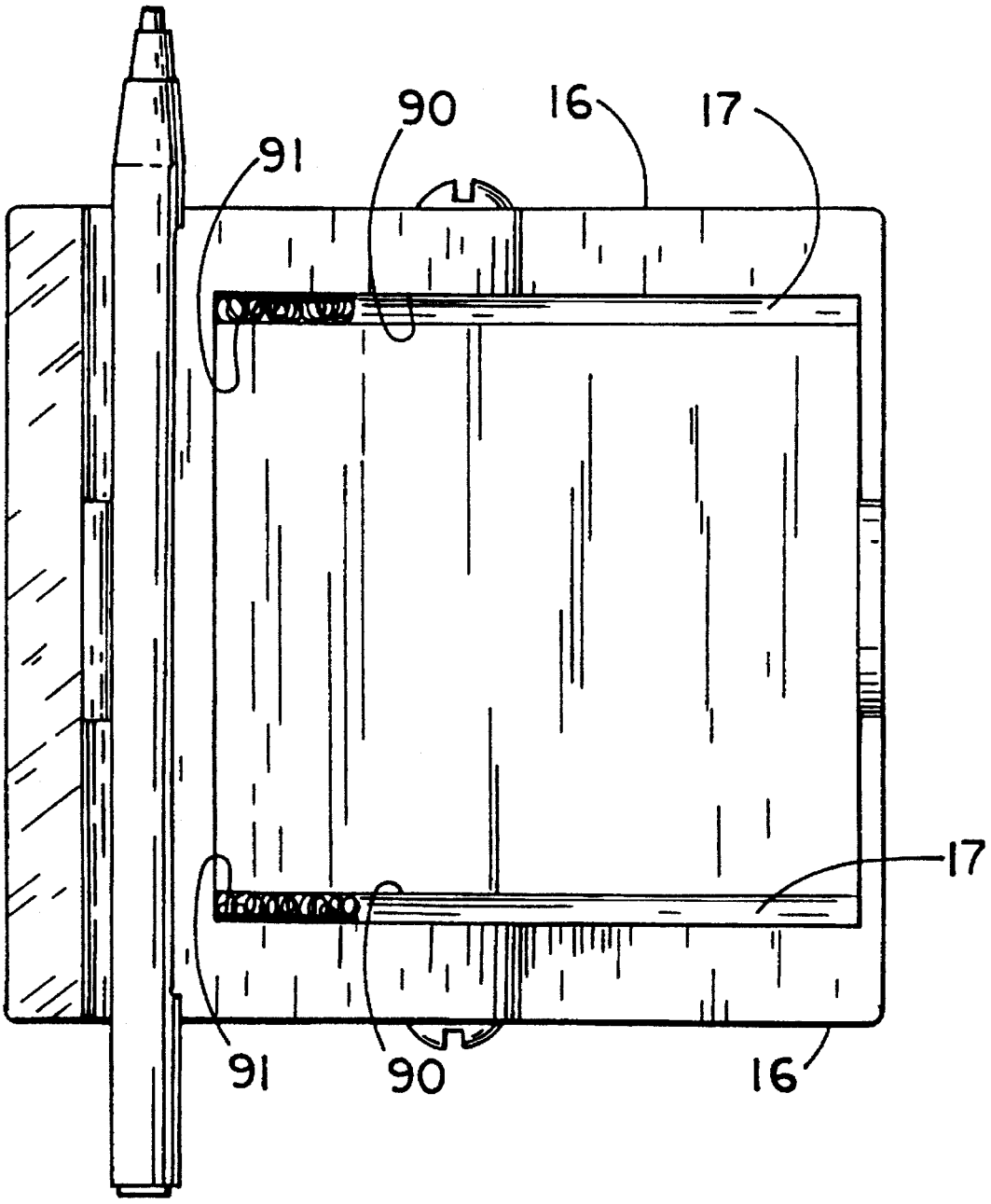
FIG. 22 is a plan view of the alternative embodiment of FIG. 20.

As can be appreciated, particularly in view of FIGS. 20 and 21, as the sheets are removed from the pad 11, the pad loses thickness, but there is still a uniform squeezing action on the bottom sheets caused by the loops of the Velcro insert 91. With the first embodiment as shown in FIGS. 1–19, it is possible that the last five or ten sheets will bow slightly, and it becomes difficult to separate them from each other.

As shown in FIGS. 20 and 21, as the sheets are removed from the pad 15, the pad shortens but there is no squeezing action on the bottom sheets any more so than the upper sheets. With the first embodiment, it is possible that the last five or ten sheets will bow slightly, and it is difficult to separate them from each other. Utilizing the releasable securable material insert 91 in connection with the pads 11, this disadvantage is avoided. Moreover, with the grip 15 such as shown in the first embodiment, it is possible for the leaf springs to fracture or crack, and they cannot be replaced. When the grips 15 become ineffective, they can be removed and replaced by a pad having a pressure sensitive bottom, or even without a pressure sensitive portion by utilizing glue.

The Method

The method of the present invention is related to and focussed directly on the pad 11. Particularly where the pad 11 is the Post-It (Minnesota Mining trademark) type with pressure sensitive sheets secured at their head portion, there is always the risk that two to four sheets will be pulled off at one time. To avoid this, means are provided to secure the pad 11 to a magazine or the like 13 to the end that open quadrants 90 of the lower portion of the pad are accessible from the right-hand or the left-hand side of the pad 11. Additionally, of course, this gives a quadrant access to the left-handed or right-handed person depending upon where he wishes to secure the receiver. Once secured, the method of the invention is practiced by riffling the pad 11 through either of the quadrants 90 at its lower quarter portions so that the individual sheets are "exercised" or "flexed" to the point where they have been separated each from the other. The action is not totally unlike picking up today's newspaper and blowing at the upper corner in order to separate the pages so that the fingers can grasp the pages, and turn from page-to-page without skipping pages. Once this activity is undertaken, the method then contemplates grasping the upper sheet, or frictionally dislodging it by lateral pressure with one of the fingers, and then grasping the same and pulling or otherwise urging removal from the pad 11. If the pad 11 is of the typical tear top type, the removal will be from left to right or right to left. With the Post-It type pad, the removal can be straight up, or even straight down as the pad, according to an important method step, is yieldably secured at its secured end or head portion by means of yieldable engagement means 15 on the magazine 13. Another aspect of the invention is mounting the pad 11 in an orientation which can be vertically on the wall, by means of a bean bag on a console, by means of a weighted base on a desk, and indeed by means of a yoke to the control column of an airplane. Additional mounting environments are contemplated as within the scope of the invention, as are back lighting aspects also.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed:

1. A holder assembly for a pad of individual sheets of paper comprising, in combination, a magazine for holding the pad, said magazine portion having a forward portion and a rearward portion, said magazine comprising a bottom, a pair of opposed sides at the forward portion of the magazine, a head essentially perpendicular to the ends of the opposed sides and located at the forward portion of the magazine, a pair of yieldable means extending from the opposed sides for yieldably engaging the pad near the head of the magazine, a mounting base for securing the magazine to an intended location for use by a user, said mounting base having lateral sides and a bottom portion, each of said lateral sides having an upstanding slotted portion that extends away from the bottom portion of said base, said magazine having two trunion assemblies, each assembly including a rotatable member having a shaft for inserting into the upstanding slotted portions of the mounting base, said rotatable member engaging a fixed member for pivotally securing the magazine to the upstanding slotted portions of the mounting base, whereby the shafts of the trunion assemblies allow the magazine to be pivotally adjusted about the upstanding slotted portions of the mounting base and whereby once the pad is placed within the magazine, the top sheet of the paper of the pad can be easily engaged by the user and can thereafter be removed.

2. A holder assembly for a pad of individual sheets of paper comprising, in combination, a magazine for holding the pad, said magazine portion having a forward portion and a rearward portion, said magazine comprising a bottom, a pair of opposed sides at the forward portion of the magazine, a head essentially perpendicular to the ends of the opposed sides and located at the forward portion of the magazine, a pair of yieldable means extending from the opposed sides for yieldably engaging the pad near the head of the magazine, a mounting base for securing the magazine to an intended location for use by a user, said mounting base having lateral sides and a bottom portion, each of said lateral sides having an upstanding slotted portion that extends away from the bottom portion of said base, said magazine having two trunion assemblies, each assembly including a rotatable member having a shaft for inserting into the upstanding slotted portions of the mounting base, said rotatable member engaging a fixed member for pivotally securing the magazine to the upstanding slotted portions of the mounting base, said magazine having a foot stop extending upwardly from the bottom of the magazine, which foot stop is centrally located on the rearward portion of the magazine to engage and support the pad, with the foot stop and the opposed sides of the magazine defining an opening that allow the user to have easy access to the sheets of paper of the pad, whereby the shafts of the trunion assemblies allow the magazine to be pivotally adjusted about the upstanding slotted portions of the mounting base and whereby once the pad is placed within the magazine, the top sheet of the paper of the pad can be easily engaged by the user and can thereafter be removed.

3. A holder assembly for a pad with a plurality of sheets of paper bound at its head, comprising, in combination, a magazine for holding the pad, said magazine portion having a forward portion and a rearward portion, said magazine comprising a bottom, a pair of opposed sides at the forward portion of the magazine, said opposed sides having opposed, yieldable, loop-like material with a textured surface for yieldably engaging the head of the pad near the head of the magazine, said material engaging the pad through pressure and partial insertion of the sheets into said material, a head essentially perpendicular to the ends of the opposed sides and located at the forward portion of the magazine, a mounting base for securing the magazine to an intended location for use by a user, whereby once the pad is placed within the magazine, the top sheet of the paper of the pad can be easily engaged by the user and can thereafter be removed.

4. A method for dispensing single sheets of paper in a pad wherein the sheets are removably secured to each other at the same end portion of the pad comprising the steps of:

securing the pad on a flat base by engaging the pad, with yieldable loop-like material with a textured surface on both sides of the pad where the sheets of the pad are removably secured to each other, said material engaging the pad through pressure and partial insertion of the sheets into said material, fanning the pad to make sure that at least one of the individual sheets is exorcised and freed from the others, and thereafter engaging the top sheet by frictionally insuring that it is separated from the sheet therebeneath, and subsequently removing the top sheet from the pad.

5. A holder assembly for a pad with a plurality of sheets of paper bound at its head, comprising, in combination, a magazine for holding the pad, said magazine portion having a forward portion and a rearward portion, said magazine comprising a bottom, a pair of opposed sides at the forward portion of the magazine, said opposed sides having opposed, yieldable, loop-like material with a textured surface for yieldably engaging the head of the pad near the head of the magazine, said material engaging the pad through pressure and partial insertion of the sheets into said material, a head essentially perpendicular to the ends of the opposed sides and located at the forward portion of the magazine, a mounting base for securing the magazine to an intended location for use by a user, said magazine having a foot stop extending upwardly from the bottom of the magazine, which foot stop is centrally located on the rearward portion of the magazine to engage and support the pad, with the foot stop and the opposed sides of the magazine defining an opening that allows the user to have easy access to the sheets of paper of the pad, whereby once the pad is placed within the magazine, the top sheet of the paper of the pad can be easily engaged by the user and can thereafter be removed.

* * * * *